US012410558B2

(12) United States Patent
Loijas et al.

(10) Patent No.: US 12,410,558 B2
(45) Date of Patent: Sep. 9, 2025

(54) BLADE SEGMENT FOR REFINER

(71) Applicant: Valmet Technologies Oy, Espoo (FI)

(72) Inventors: Marko Loijas, Valkeakoski (FI); Tomi Iisakkila, Valkeakoski (FI); Håkan Sjöström, Valkeakoski (FI)

(73) Assignee: Valmet Technologies Oy, Espoo (FI)

( * ) Notice: Subject to any disclaimer, the term of this patent is extended or adjusted under 35 U.S.C. 154(b) by 342 days.

(21) Appl. No.: 18/007,679

(22) PCT Filed: Jun. 2, 2021

(86) PCT No.: PCT/EP2021/064841
§ 371 (c)(1),
(2) Date: Dec. 1, 2022

(87) PCT Pub. No.: WO2021/245161
PCT Pub. Date: Dec. 9, 2021

(65) Prior Publication Data

US 2023/0228033 A1 Jul. 20, 2023

(30) Foreign Application Priority Data

Jun. 5, 2020 (EP) ..... 20178487

(51) Int. Cl.
*D21D 1/24* (2006.01)
*D21D 1/00* (2006.01)
(Continued)

(52) U.S. Cl.
CPC ..... *D21D 1/24* (2013.01); *D21D 1/008* (2013.01); *D21D 1/26* (2013.01); *D21D 1/306* (2013.01)

(58) Field of Classification Search
CPC ..... D21D 1/008; D21D 1/24; D21D 1/26; D21D 1/306; D21D 1/006; D21D 1/22; D21D 1/30; D21D 1/303; B02C 7/12
See application file for complete search history.

(56) References Cited

U.S. PATENT DOCUMENTS 56,433 A * 7/1866 Moore ..... B02C 7/12 241/298
1,329,742 A * 2/1920 Bausman ..... B02C 7/12 241/298

(Continued)

FOREIGN PATENT DOCUMENTS

EP 3401439 B1 10/2019

OTHER PUBLICATIONS

International Search Report for PCT/EP2021/064841 dated Aug. 6, 2021.

(Continued)

*Primary Examiner* — Jared O Brown
*Assistant Examiner* — Matthew Stephens
(74) *Attorney, Agent, or Firm* — Stiennon & Stiennon

(57) ABSTRACT

A blade segment (4, 8) for a refiner (1) for refining fibrous material has first (20) and second (21) end edges opposite one another in a direction of a longitudinal axis (LA) of the blade segment (4, 4*a*, 4*b*, 8, 8*a*, 8*b*), and first (22) and second (23) side edges which extend between the first end edge and the second end edge. The blade segment has a refining surface (5, 9) with blade bars (26) and grooves (27) therebetween on a front surface (25) of the blade segment (4, 8). At least one side edge (22, 23) has at least two edge portions (31, 33, 35, 41, 43, 45) arranged to deviate from the direction of the longitudinal axis (LA) of the blade segment (4, 4*a*, 4*b*, 8; 8*a*, 8*b*) and connected by an elbow (32, 34, 42, 44) between each two edge portions (31, 33, 35, 41, 43, 45).

14 Claims, 5 Drawing Sheets

(51) Int. Cl.
*D21D 1/26* (2006.01)
*D21D 1/30* (2006.01)

(56) References Cited

U.S. PATENT DOCUMENTS

| | | | | |
|---|---|---|---|---|
| 2013/0306770 | A1* | 11/2013 | Sjostrom | D21D 1/303 241/245 |
| 2017/0191218 | A1* | 7/2017 | Tichy | D21D 1/306 241/245 |
| 2018/0327970 | A1* | 11/2018 | Sjöström | D21D 1/306 241/245 |
| 2020/0246801 | A1* | 8/2020 | Singhal | D21D 1/306 241/245 |

OTHER PUBLICATIONS

Written Opinion of the International Searching Authority for PCT/EP2021/064841 dated Aug. 6, 2021.

* cited by examiner

BLADE SEGMENT FOR REFINER

CROSS REFERENCES TO RELATED APPLICATIONS

This application is a US national phase application based on PCT/EP2021/064841 filed on Jun. 2, 2021, and claims priority on EP20178487, filed on Jun. 5, 2020, the disclosures of which are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to refiners for refining fibrous material and especially to a blade segment for a refiner for refining fibrous material.

Refiners used for refining fibrous material, such as refiners used for manufacturing mechanical pulp or in any low consistency refining, comprise typically two refining elements opposite to each other and turning relative to each other, i.e., one or both of them is/are rotating. The refining elements comprise refining surfaces provided with blade bars and blade grooves therebetween, the blade bars being intended to defiber and refine the material to be refined and the blade grooves being intended to convey the material to be refined forward along the refining surfaces. The refining surface of the refining element is typically formed of several blade segments fastened to a body of the respective refining element, each blade segment comprising a respective refining surface formed by blade bars and blade grooves therebetween. The complete refining surface of the refining element is thus formed of the refining surfaces of several blade segments fastened next to each other in the refining element. EP-publication 3401439 B1 discloses a blade segment applicable to be used in refiners for refining fibrous material.

SUMMARY OF THE INVENTION

An object of the present invention is to provide a novel blade segment for a refiner for refining fibrous material, as well as a novel refiner for refining fibrous material.

The invention is based on the idea of configuring at least one side edge of the blade segment to provide such a shape that deviates from a direction of a longitudinal axis of the blade segment.

When the shape of at least one side edge of the blade segment is arranged to have a shape that deviates from the direction of the longitudinal axis of the blade segment, and when the configuration of the opposite side edge is selected in cooperation with the configuration of the first mentioned side edge, it provides longitudinal slit-like openings providing flow paths between the neighboring blade segments for supplying the fibrous material to be refined into the refining chamber between the stator and the rotor and for discharging the fibrous material already refined out of the refining chamber. This slit-like opening has therefore a center line the direction of which deviates from the direction of the longitudinal axis of the blade segment at least at most part of the extension of the opening. This has the effect that an angle of incidence between the openings in the rotor and in the stator changes in the axial direction of the refiner, causing a point of incidence between the openings in the rotor and in the stator to move from the axial direction of the refiner. This, in turn, has the effect that possible flow variations appearing in an operation of a refiner of prior art may be diminished.

BRIEF DESCRIPTION OF THE DRAWINGS

For the sake of clarity, the figures show some embodiments of the invention in a simplified manner. Like reference numerals identify like elements in the figures.

DESCRIPTION OF THE PREFERRED EMBODIMENTS

Figure 1:
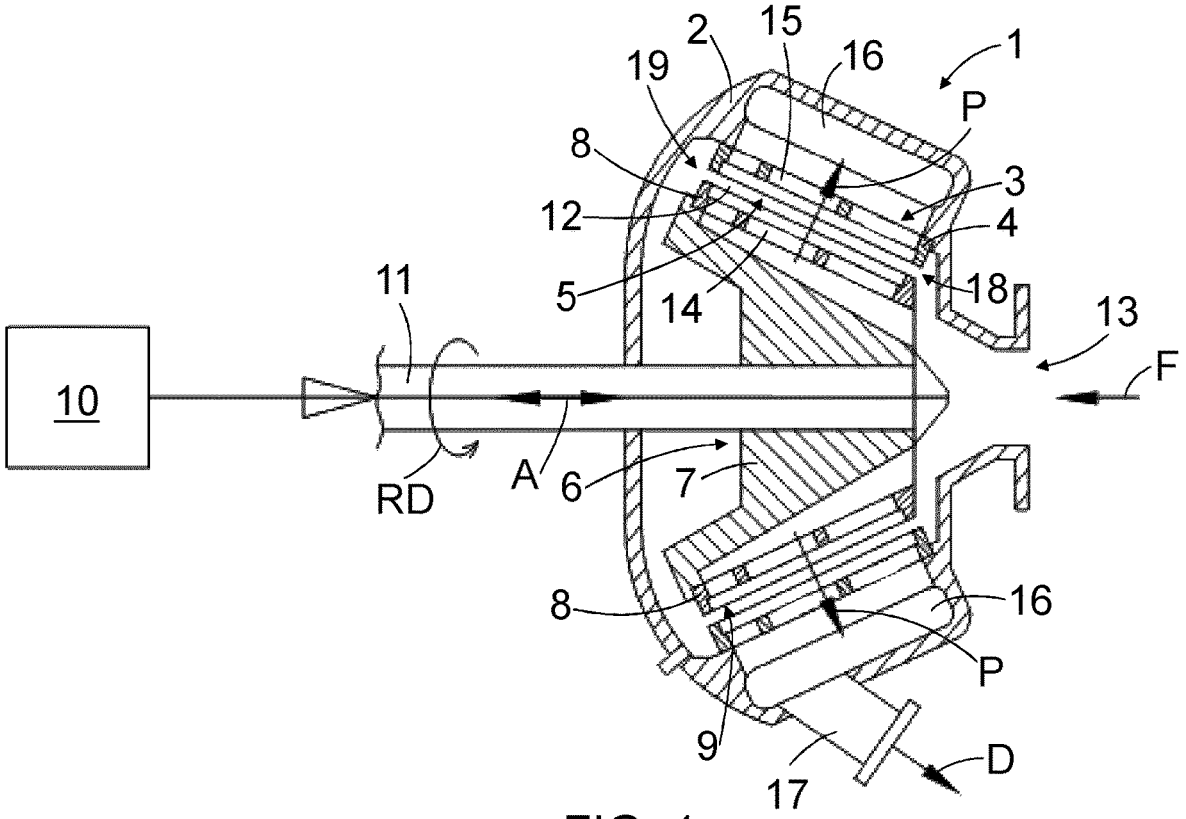
FIG. 1 is a schematic general side view of a conical refiner in cross-section.

FIG. 1 is a schematic general side view of a general construction of a refiner 1 in cross-section, which refiner may be used for refining a fibrous material, such as a wood material containing lignocellulose or another fiber material suitable to be used for manufacturing paper or paperboard, for example. The refiner 1 shown in FIG. 1 is of conical type but disc-refiners, conical-disc-refiners and cylindrical refiners could be used as well as an example here. Generally, a refiner comprises at least two substantially oppositely positioned refining elements at least one of which is rotating, and a refining chamber formed between each two substantially oppositely positioned refining elements. In the following a refiner with only one rotatable refining element is described.

The refiner 1 of FIG. 1 comprises a frame 2 and a stationary, fixed refining element 3, i.e., a stator 3, supported on the frame 2. The stator 3 comprises two or more stator blade segments 4, each of them comprising blade bars and blade grooves therebetween. The blade bars and the blade grooves in each stator blade segment 4 form a refining surface 5 of the respective blade segment 4, the refining surface 5 of each stator blade segment 4 thereby providing a part of a refining surface of the stator 3. A complete refining surface of the stator 3 is formed of the refining surfaces 5 of a necessary number of the blade segments 4 fastened next to each other in the stator 3 so that the complete refining surface 5 extending over the whole circumference of the stator 3 is provided. For the sake of clarity, both the refining surface of each single stator blade segment 4 as well as the complete refining surface of the stator 3 are herein denoted with the same reference sign 5.

The refiner 1 further comprises a rotatable refining element 6, i.e., a rotor 6, of the refiner 1. The rotor 6 comprises a hub 7. The rotor 6 further comprises two or more rotor blade segments 8 supported to the hub 7, each rotor blade segment 8 comprising blade bars and blade grooves therebetween. The blade bars and the blade grooves in each rotor blade segment 8 form a refining surface 9 of the respective blade segment 8, the refining surface 9 of each rotor blade segment 8 thereby providing a part of a refining surface of the rotor 6. A complete refining surface of the rotor 6 is formed of the refilling surfaces 9 of a necessary number of the blade segments 8 fastened next to each other in the rotor 6 so that the complete refining surface 9 extending over the whole circumference of the rotor 6 is provided. For the sake of clarity, both the refining surface of each single rotor blade segment 8 as well as the complete refining surface of the rotor 6 are herein denoted with the same reference sign 9.

The hub 7 of the rotor 6 is connected to a driving motor 10 by a shaft 11 so that the rotor 6 can be rotated relative to the stator 3 in a direction of arrow RD, for instance, the arrow RD thus indicating an intended rotation direction RD of the rotor 6.

The refiner 1 may also comprise a loading device which, for the sake of clarity, is not shown in FIG. 1. The loading device can be used for moving back and forth the rotor 6 attached to the shaft 11, as schematically shown by arrow A, in order to adjust a size of a refining gap 12, i.e., a refining chamber 12, between the stator 3 and the rotor 6, wherein the fibrous material is actually refined.

The fibrous material to be refined is fed into the refiner 1 via a feed channel 13 in a manner shown by arrow F. In one embodiment most of the fibrous material fed into the refiner 1 passes, in a manner schematically shown by arrows P, through openings 14, i.e., flow paths, in the refining surface 9 of the rotor 6 into the refining chamber 12, wherein the fibrous material is to be refined. Furthermore, most of the already refined fibrous material is, in turn, discharged through openings 15, i.e., flow paths, in the refining surface 9 of the stator 3 into an intermediate space 16 between the frame 2 of the refiner 1 and the stator 3, wherefrom the refined material is removed via a discharge channel 17 from the refiner 1, as schematically shown by arrow D.

Since the space between the rotor 6 and the frame 2 of the refiner 1 of FIG. 1 is not fully closed, some of the fibrous material to be fed into the refiner 1 may transfer into the refining chamber 12 from the right end of the refining chamber 12, i.e., from a first end 18 or an inner end 18 of the refiner 1 having a smaller diameter, as seen in FIG. 1. Correspondingly, some of the already refined material may also exit the refining chamber 12 from the left end of the refining chamber 12, i.e., from a second end 19 or an outer end 19 of the refiner 1 having a larger diameter, as seen in FIG. 1, wherefrom a connection is provided to the intermediate space 16.

In the embodiment of FIG. 1 of the refiner 1, only one feed channel 13 is provided, and it is arranged at the first end 18 of the refiner 1 having the smaller diameter. The actual implementation of the refiner could also comprise a second feed channel arranged at the second end 19 of the refiner 1 having the larger diameter, whereby the discharge channel 17 of the refiner 1 could be arranged for example somewhere between the first 18 and second 19 ends of the refiner 1. In the following, the reference sign 18 and the term first end 18 or the term inner end 18 may indicate both the first end 18 or the inner end 18 of the refiner 1 having the smaller diameter and the first end 18 or the inner end 18 of the refining element 3, 6 or of the refining chamber 12 having the smaller diameter. Correspondingly, the reference sign 19 and the term second end 19 or the term outer end 19 may indicate both the second end 19 or the outer end 19 of the refiner 1 having the larger diameter and the second end 19 or the outer end 19 of the refining element 3, 6 or of the refining chamber 12 having the larger diameter.

It is emphasized that in addition to the conical refiner disclosed above the blade segment of the solution described herein may be applied in other kinds of conical refiners too. In addition to the conical refiners the blade segment of the solution described herein is applicable also in cylindrical refiners and disc refiners as well as in refiners comprising both a conical portion and a disc portion.

Figure 2:
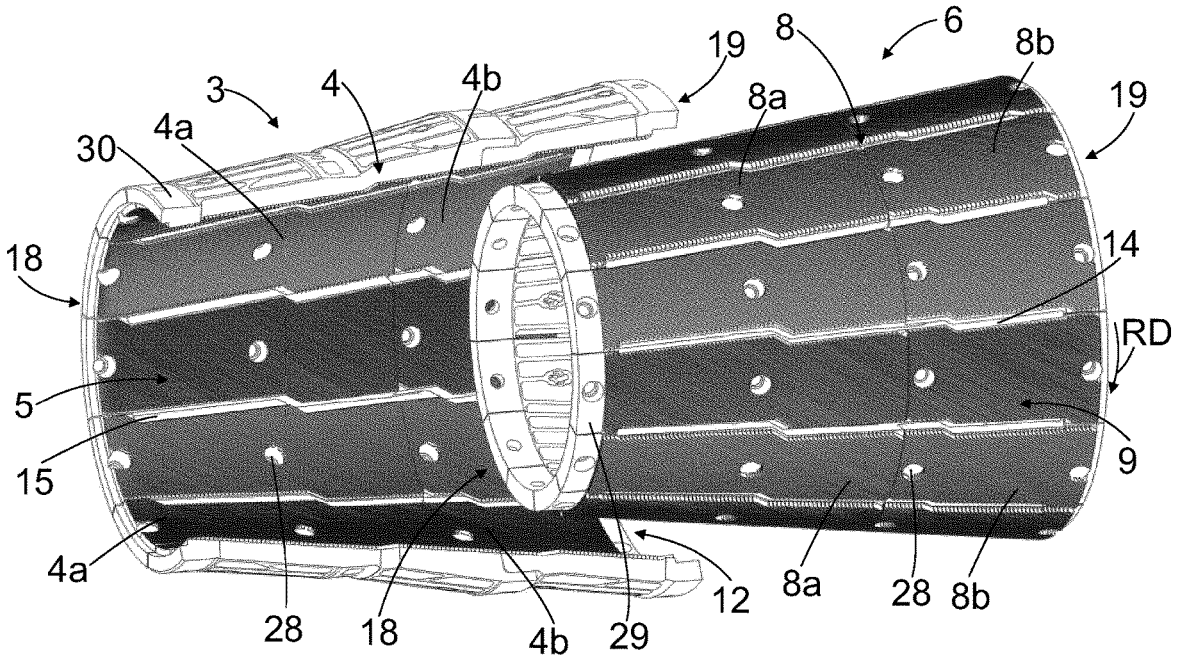
FIG. 2 is a schematic oblique side view, partially broken away, of a stator and a rotor applicable to be used in the refiner of FIG. 1.

FIG. 2 is a schematic oblique side view of a stator 3 and a rotor 6 of a conical refiner, the stator 3 being shown in cross-section. In the circumferential direction of the stator 3 there are a number of adjacent inner blade segments 4*a* on the side of the inner end 18 of the stator 3 and a respective number of adjacent outer blade segments 4*b* on the side of the outer end 19 of the stator 3, which inner 4*a* and outer 4*b* segments together provide a blade segment 4. Each inner blade segment 4*a* is interconnected with the respective outer blade segment 4*b* at the corresponding circumferential position of the stator 3, providing a blade segment 4 that provides a substantially continuous refining surface 5 between the inner end 18 and the outer end 19 of the stator 3 at the respective inner 4*a* and outer 4*b* stator blade segments of this blade segment 4. Side edges of the stator blade segments 4*a*, 4*b* are implemented such that slit-like openings 15 making flow paths are provided between the interconnected stator blade segments 4 in the circumferential direction of the stator 3.

Figure 3:
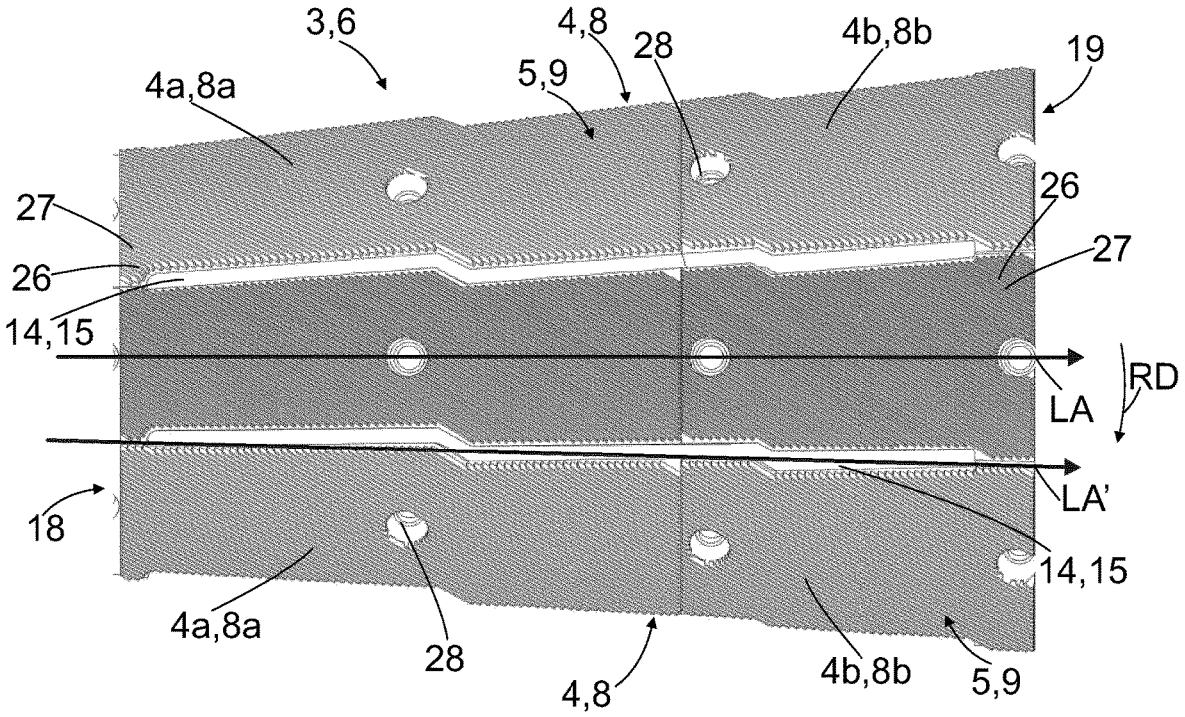
FIG. 3 is a schematic planar upper view of a set of stator/rotor blade segments.

Similarly, in the circumferential direction of the rotor 6 there are a number of adjacent inner blade segments 8*a* on the side of the inner end 18 of the rotor 6 and a respective number of adjacent outer blade segments 8*b* on the side of the outer end 19 of the rotor 6, which inner 8*a* and outer 8*b* blade segments together provide a blade segment 8. Each inner blade segment 8*a* is interconnected with the respective outer blade segment 8*b* at the corresponding circumferential position of the rotor 6, providing a blade segment 8 that provides a substantially continuous refilling surface 9 between the inner end 18 and the outer end 19 of the rotor 6 at the respective inner 8*a* and outer 8*b* stator blade segments of this blade segment 8. Side edges of the rotor blade segments 8*a*, 8*b* are implemented such that slit-like openings 14 making flow paths are provided between the interconnected rotor blade segments 8 in the circumferential direction of the rotor 6. FIG. 3 is a schematic planar upper view of a set of adjacent interconnected stator blade segments 4*a*, 4*b* or rotor blade segments 8*a*, 8*b* applicable to be used for forming a part of the refilling surface 5, 9 of a stator 3 or a rotor 6 substantially similar to that of FIG. 2.

When the rotor blade segments 8*a*, 8*b* are fastened to the hub 7 of the rotor 6, there will thus be longitudinal slit-like openings 14 between the neighboring rotor blade segments 8 in the circumferential direction of the rotor 6, through which openings 14 the fiber material to be refined is supplied into the refining chamber 12 between the rotor 6 and the stator 3. Similarly, there will be longitudinal slit-like openings 15 between the neighboring stator blade segments 4 in the circumferential direction of the stator 3, through which openings 15 the fiber material already refined in the refining chamber 12 is discharged out of the refilling chamber 12. The configuration of this kind of refiner is called a side feed configuration or a side feed refiner.

Figure 4A:
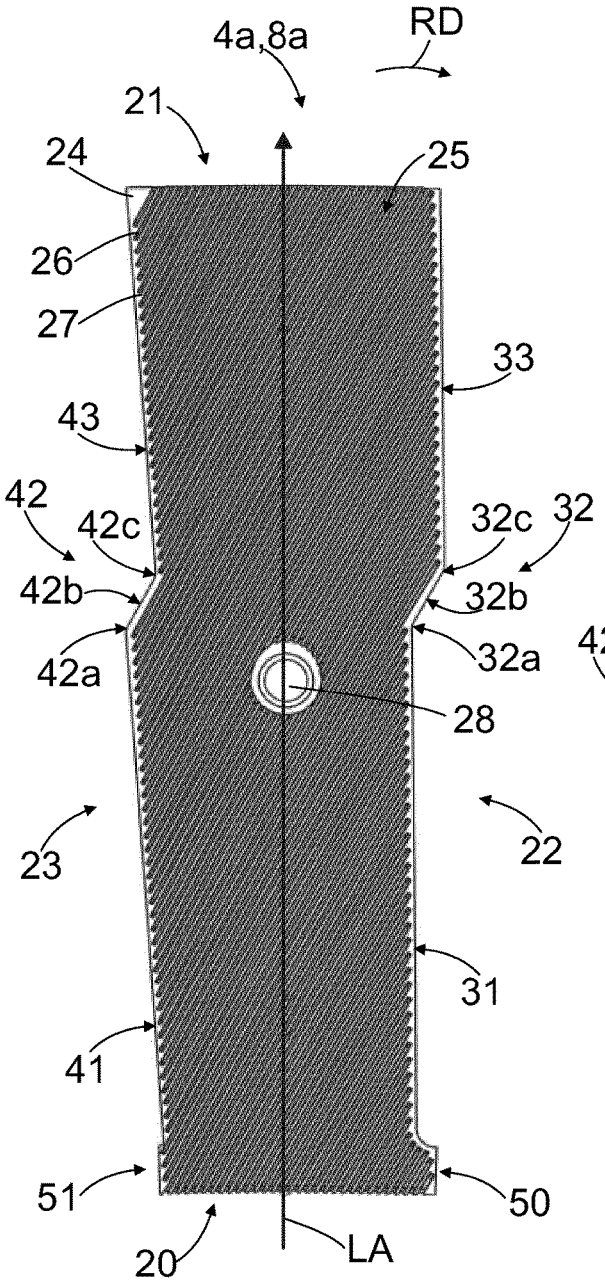
FIGS. 4*a* and 4*b* are schematic planar upper views of blade segments according to the solution.
Figure 4B:
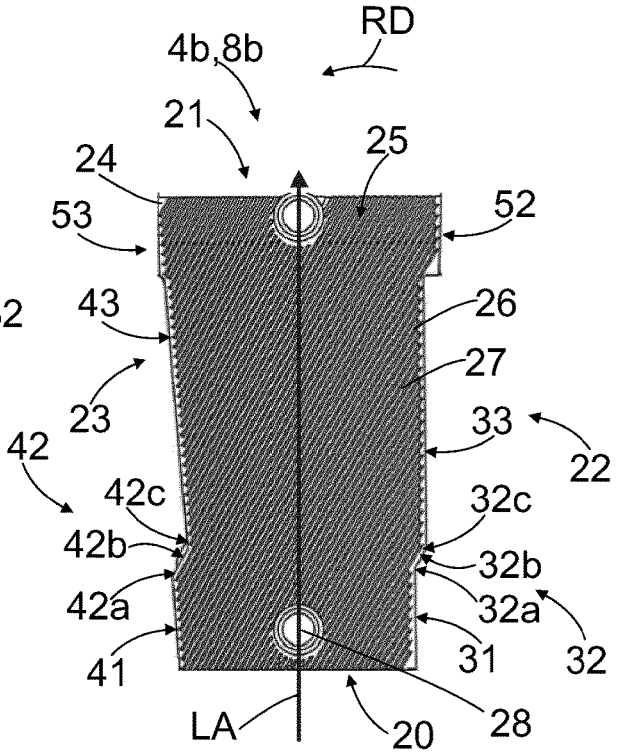
Figure 5:
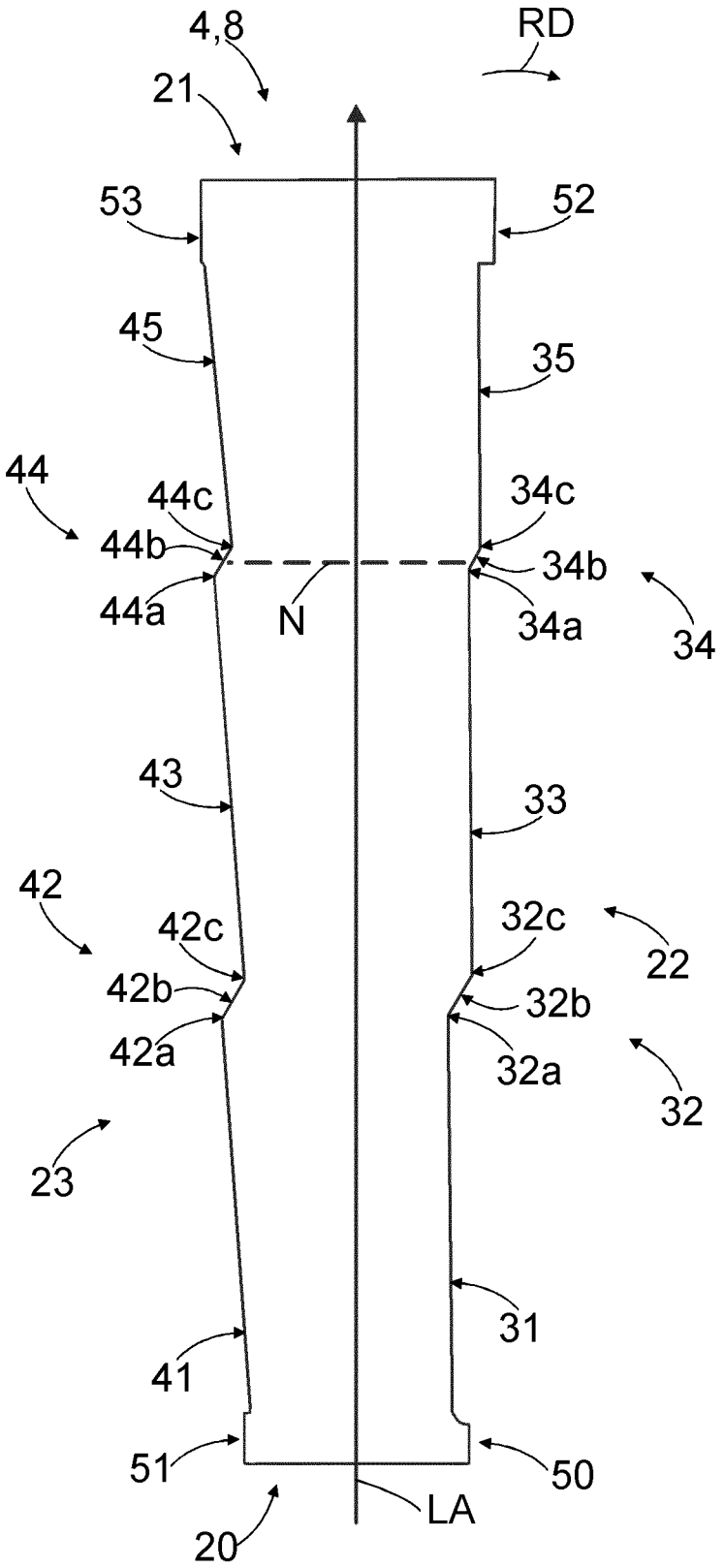
FIGS. 5 and 6 show a schematic planar upper view of another blade segment according to the solution.
Figure 6:
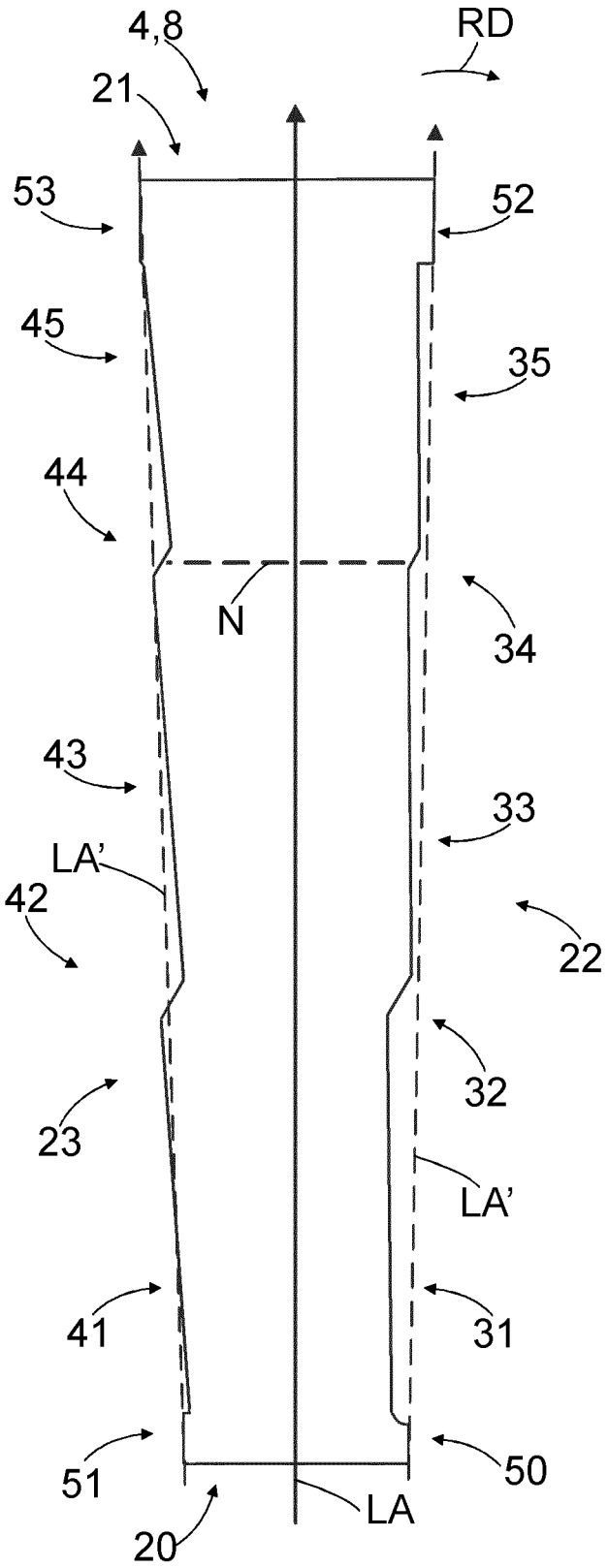

In the following the blade segment structure according to the solution disclosed herein is considered in more detail in view of FIGS. 4*a*, 4*b*, 5 and 6, wherein FIG. 4*a* shows schematically a planar upper view of a blade segment 4*a*, 8*a* applicable to be used on the side of the inner end 18 of the stator 3 or the rotor 6 and FIG. 4*b* shows schematically a planar upper view of a blade segment 4*b*, 8*b* applicable to be used on the side of the outer end 19 of the stator 3 or the rotor 6. FIGS. 5 and 6, in turn, disclose schematically a planar upper view of another blade segment 4, 8 applicable to be used in a stator 3 and/or a rotor 6 of a conical refiner, the refining surface 5, 9 of the blade segment 4, 8 being omitted in FIGS. 5 and 6 for the sake of clarity. When considering FIG. 2 above, the blade segment 4, 8 of FIGS. 5 and 6 is intended to extend as a single uniform piece from the inner end 18 of the stator 3/rotor 6 up to the outer end 19 of the stator 3/rotor 6. The following description is thus applicable to each blade segment 4, 4*a*, 4*b*, 8, 8*a*, 8*b* mentioned above, including the blade segments 4,8 8 being formed by interconnecting the inner 4*a*, 8*a* and respective outer 4*b*, 8*b* blade segments.

The blade segment 4, 4*a*, 4*b*, 8, 8*a*, 8*b* comprises an inner end edge 20 or a first end edge 20 to be directed towards the inner end 18 of the refining element 3, 6 having the smaller diameter. The blade segment further comprises an outer end edge 21 or a second end edge 21 to be directed towards the outer end 19 of the refining element 3, 6 having the larger diameter. In blade segments for the conical and cylindrical refiners the inner end edge of the blade segment provides an axially inner end of the blade segment and the outer end edge of the blade segment provides an axially outer end of the blade segment, the direction from the axially inner end towards the axially outer end thus providing the longitudinal axis of the blade segment. The outer end edge 21 is thus substantially opposite to the inner end edge 20 in the direction of the longitudinal axis of the blade segment. In FIG. 3 the longitudinal axis LA of the blade segment is shown schematically by arrows both at a center line of the blade segments as well as at an edge line of the blade segments, which lines seem to have a common intersecting point outside of FIG. 3 in response to the representation of the segment of conical shape on the planar view but in the actual segment the respective lines or arrows would be parallel in the view of FIG. 3. In other words, the arrow denoted with the reference sign LA and being at the center line of the blade segment refers to the longitudinal axis of the blade segment at the center line of the blade segment and the arrow denoted with the reference sign LA' and being at an edge line or edge of the blade segment refers to the longitudinal axis of the blade segment at the edge of the blade segment. The longitudinal axis LA' is thus the longitudinal axis LA as shown at the edge of the blade segment. Thus, the longitudinal axis LA and the longitudinal axis LA' both represent the one and same longitudinal axis of the blade segment but are denoted herein with different reference signs for the description below. In the discussion below, the longitudinal axis LA at the edge line of the blade segment is also called an edge axis and is denoted with the reference sign LA' and is shown with broken lines in FIG. 6. In FIGS. 4*a*, 4*b* and 5 the longitudinal axes of the blade segments are shown schematically at center lines of the blade segments and are therefore denoted with the reference sign LA.

It is to be noted that in the blade segment intended for a conical refiner, a line denoting the longitudinal axis LA of the blade segment actually runs along the conical surface of the blade segment and therefore runs at an angle relative to the shaft 11 of the conical refiner 1 but may be projected at the shaft 11 so as to run parallel to the shaft 11 of the refiner 1. In a blade segment intended for a cylindrical refiner, in turn, a line denoting the longitudinal axis LA of the blade segment running along the cylindrical surface of the blade segment runs substantially parallel to the shaft of the refiner. Furthermore, in a blade segment intended for a disc refiner, in turn, a line denoting the longitudinal axis LA of the blade segment runs along a substantially planar surface of the blade segment in a radial direction of the blade segment, i.e., in disc-like blade segments the longitudinal axis of the blade segment unites with the radial direction of the blade segment.

The blade segment further comprises a first side edge 22 or a leading side edge 22 extending from the inner end edge 20 of the blade segment up to the outer end edge 21 of the blade segment and providing the side edge of the blade segment which first meets the edge of a counter blade segment during operation of the refiner. So, in the rotor 6 it provides the side edge of the blade segment to be directed towards the intended rotation direction RD of the rotor 6 and in the stator 3 it provides the side edge of the blade segment to be directed to the opposite direction relative to the intended rotation direction RD of the rotor 6.

The blade segment further comprises a second side edge 23 or a trailing side edge 23 substantially opposite to the first side edge 22 in a direction substantially perpendicular to the longitudinal axis LA of the blade segment and extending from the inner end edge 20 of the blade segment up to the outer end edge 21 of the blade segment and providing the side edge of the blade segment which last meets the edge of a counter blade segment during operation of the refiner. So, in the rotor 6 it provides the side edge of the blade segment to be directed to the opposite direction relative to the intended rotation direction RD of the rotor 6 and in the stator 3 it provides the side edge to be directed towards the intended rotation direction RD of the rotor 6. The inner 20 and the outer 21 end edges together with the first 22 and second 23 side edges define a periphery of the blade segment 8.

The blade segment comprises a body 24 having a front surface 25 to be directed towards the refining chamber 12 of the refiner 1. The front surface 25 of the blade segment body 24 is provided with blade bars 26 and blade grooves 27 which together provide the refining surface 5, 9 of the blade segment. The blade bars 26 are intended to defiber and refine the material to be refined and the blade grooves 27 are intended to convey the material to be refined forward along the refining surface 5, 9. Fastening holes 28 are intended to receive fastening means, like bolts, for fastening the blade segment to the supporting structures of the stator and the hub of the rotor directly or via fastening elements, like rings, 29, 30 or the like.

At the innermost and outermost end edges of the segment there is an extension or shoulder 50, 51, 52, 53 at least on one side edge 22, 23 of the segment. The extension or shoulder is intended to come into contact with a neighboring blade segment when assembled to provide a part of a refining surface of a refining element of a refiner. FIG. 4*a* and FIG. 5 show the shoulders 50, 51 at the inner end of the blade segments. 4, 4*a*, 8, 8*a* and FIG. 4*b* and FIG. 5 show the shoulders 52, 53 at the outer end of the blade segments 4, 4*b*, 8, 8*b*. The shoulders 50, 51, 52, 53 may lie on corners of one segment as in FIG. 5, or on corners of separate successive segments, i.e., on corner(s) of the inner segment 4*a*, 8*a* and on corner(s) of an outer segment 4*b*, 8*b* as seen in FIGS. 4*a* and 4*b*. Naturally, all the corners of the segment 4, 8 could be provided with a shoulder 50, 51, 52, 53 and, similarly with the embodiment of FIGS. 4*a*, 4*b* the inner segment 4*a*, 8*a* could have shoulders 50, 51 on both side edges at the inner edge 20 or alternatively on each corner thereof, and respectively, the outer segment 4*b*, 8*b* could have shoulders 52, 53 on both side edges at the outer edge 21 or alternatively on each corner thereof. The amount of shoulders per side edge of one segment is from 2 to 10. Basically, these shoulders 50, 51, 52, 53 are the only or the few portions at which the segments are in mutual sidewise contact to its neighboring segment.

In FIG. 6 there are also drawn edge axes LA' along the shoulder lines 50, 51, 52, 53, more specifically via the seam lines between the two neighboring segments, and running parallel to the axial direction of the refiner (or the radial direction in case of a disc refiner) just like the longitudinal axis LA of the segment but presented herein at the edge of the blade segment in the way discussed already above. The slit-like opening 14, 15 is formed on the first side edge 22 between the inner shoulder 50 and the outer shoulder 52, and on the second side edge 23 between the inner shoulder 51 and the outer shoulder 53. The slit-like longitudinal opening 14, 15 may run continuously from the innermost shoulder up to the outermost shoulder without interruptions other than those caused by ex-segment structures, like fastening rings. Alternatively, the slit-like longitudinal opening 14, 15 may be discontinuous between the innermost and outermost shoulders when the elbows are designed to have a contact with the neighboring segment, as disclosed in more detail later.

Referring to FIGS. 4*a*, 4*b* and 5 and the blade segments 4, 8 therein, the first side edge 22 comprises, in a direction from the inner end edge 20 towards the outer end edge 21, at least a substantially straight first long edge portion 31. The direction of the first long edge portion 31 is arranged to deviate from the direction of the longitudinal axis LA of the blade segment, i.e., with respect to the direction of the longitudinal axis LA of the blade segment, such that the first long edge portion 31 is directed towards the center part or the center line of the blade segment, the center line of the blade segment being denoted in FIGS. 4*a*, 4*b* and 5 by the longitudinal axis LA of the blade segment.

The first long edge portion 31 is followed by a first bend 32*a*, which is turned away from the direction of the first long edge portion 31, i.e., to an opposite direction with respect to the direction of the longitudinal axis LA than the first long edge portion 31, that is away from the center part or the center line of the blade segment.

The first bend 32*a* is followed by a substantially straight or slightly curved short edge portion 32*b*. The direction of the short edge portion 32*b* is arranged to deviate from the direction of the longitudinal axis LA to a different direction than the first long edge portion 31, i.e., to an opposite direction with respect to the direction of the longitudinal axis LA than the first long edge portion 31, that is away from the center part or the center line of the blade segment.

The short edge portion 32*b* is followed by a second bend 32*c* which is turned away from the direction of the first short edge portion 32*b*, i.e., to an opposite direction with respect to the direction of the longitudinal axis LA than the short edge portion 32*b*, that is towards the center part or the center line of the blade segment. The second bend 32*b* is thus turned towards an opposite direction relative to the longitudinal axis LA than the first bend 32*a*.

The first bend 32*a*, the short edge portion 32*b* and the second bend 32*c* provide an elbow 32 in the first side edge 22 of the blade segment. In other words, the elbow 32 in the first side edge 22 of the blade segment consists of the first bend 32*a*, a short edge portion 32*b* following the first bend 32*a* and a second bend 32*c* following the short edge portion 32*b*.

The second bend 32*c* or the elbow 32 is, in turn, followed by a substantially straight second long edge portion 33 the direction of which is arranged to deviate from the direction of the longitudinal axis LA of the blade segment to the same direction as the first long edge portion 31, i.e., towards the center part or the center line of the blade segment. In other words, the second bend 32*c* and, thus, the elbow 32 is followed by a substantially straight second long edge portion 33 the direction of which is arranged to deviate from the direction of the longitudinal axis LA of the blade segment to the same direction as the first long edge portion 31. The second long edge portion 33 is thus arranged to deviate with respect to the direction of the longitudinal axis LA to the same direction as the first long edge portion 31.

Furthermore, the second side edge 23 of the blade segments 4, 4*a*, 4*b*, 8, 8*a*, 8*b* comprises, in a direction from the inner end edge 20 towards the outer end edge 21, at least a substantially straight first long edge portion 41. The direction of the first long edge portion 41 is arranged to deviate from the direction of the longitudinal axis LA of the blade segment, i.e., with respect to the direction of the longitudinal axis LA of the blade segment, such that the first long edge portion 41 is directed away from the center part or the center line of the blade segment.

The first long edge portion 41 is followed by a first bend 42*a*, which is turned away from the direction of the first long edge portion 41, i.e., to an opposite direction with respect to the direction of the longitudinal axis LA than the first long edge portion 41, that is towards the center part or the center line of the blade segment.

The first bend 42*a* is followed by a substantially straight or slightly curved short edge portion 42*b*. The direction of the short edge portion 42*b* is arranged to deviate from the direction of the longitudinal axis LA to a different direction than the first long edge portion 41, i.e., to an opposite direction with respect to the direction of the longitudinal axis LA than the first long edge portion 41, that is towards the center line of the blade segment.

The short edge portion 42*b* is followed by a second bend 42*c* which is turned away from the direction of the first short edge portion 42*b*, i.e., to an opposite direction with respect to the direction of the longitudinal axis LA than the short edge portion 42*b*, that is away from the center line of the blade segment. The second bend 42*c* is thus turned towards an opposite direction relative to the longitudinal axis LA than the first bend 42*a*.

The first bend 42*a*, the short edge portion 42*b* and the second bend 42*c* provide an elbow 42 in the second side edge 23 of the blade segment. In other words, the elbow 42 in the second side edge 23 of the blade segment consists of the first bend 42*a*, a short edge portion 42*b* following the first bend 42*a* and a second bend 42*c* following the short edge portion 42*b*.

The second bend 42*c* or the elbow 42 is, in turn, followed by a substantially straight second long edge portion 43 the direction of which is arranged to deviate from the direction of the longitudinal axis LA of the blade segment to the same direction as the first long edge portion 41, i.e., away from the center part or the center line of the blade segment. In other words, the second bend 42*c* and, thus, the elbow 42 is followed by a substantially straight second long edge portion 43 the direction of which is arranged to deviate from the direction of the longitudinal axis LA of the blade segment to the same direction as the first long edge portion 41. The second long edge portion 43 is thus arranged to deviate with respect to the direction of the longitudinal axis LA to the same direction as the first long edge portion 41.

When further considering the blade segment 4, 8 of FIG. 5, the first side edge 22 of the blade segment 4, 8 of FIG. 5 further comprises another bevel 34 following the second long edge portion 33. Thereby the second long edge portion 33 is followed by a third bend 34*a*, which is turned away from the direction of the second long edge portion 33, i.e., to an opposite direction with respect to the direction of the longitudinal axis LA than the second long edge portion 33, that is away from the center part or the center line of the blade segment.

The third bend 34*a* is followed by a second substantially straight or slightly curved short edge portion 34*b*. The direction of the second short edge portion 34*b* is arranged to deviate from the direction of the longitudinal axis LA to a different direction than the second long edge portion 33, i.e., to an opposite direction with respect to the direction of the longitudinal axis LA than the second long edge portion, that is away from the center part or the center line of the blade segment.

The second short edge portion 34*b* is followed by a fourth bend 34*c* which is turned away from the direction of the second short edge portion 34*b*, i.e., to an opposite direction with respect to the direction of the longitudinal axis LA than the second short edge portion 34*b*, that is towards the center part or the center line of the blade segment. The fourth bend 34*c* is thus turned towards an opposite direction relative to the longitudinal axis LA than the third bend 34*a*.

The third bend 34*a*, the second short edge portion 34*b* and the fourth bend 34*c* provide a second elbow 34 in the first side edge 22 of the blade segment. In other words, the second elbow 34 in the first side edge 22 of the blade segment consists of the third bend 34*a*, a second short edge portion 34*b* following the third bend 34*a* and a fourth bend 34*c* following the short edge portion 34*b*.

The fourth bend 34*c* or the second elbow 34 is, in turn, followed by a substantially straight third long edge portion 35 the direction of which is arranged to deviate from the direction of the longitudinal axis LA of the blade segment to the same direction as the first 31 and the second 33 long edge portions, i.e., towards the center part or the center line of the blade segment. In other words, the fourth bend 34*c* and, thus the second elbow 34 is followed by a substantially straight third long edge portion 35 the direction of which is arranged to deviate from the direction of the longitudinal axis LA of the blade segment to the same direction as the first 31 and the second 33 long edge portions. The third long edge portion 35 is thus arranged to deviate with respect to the direction of the longitudinal axis LA to the same direction as the first 31 and the second 33 long edge portions.

The ratio of a length of the short edge portion 32*b*, 34*b* to a length of the long edge portion 31, 33, 35 is about 1:2-1:20.

Similarly, the second side edge 23 of the blade segment 4, 8 of FIG. 5 comprises another bevel 44 following the second long edge portion 43. Thereby the second long edge portion 43 is followed by a third bend 44*a*, which is turned away from the direction of the second long edge portion 43, i.e., to an opposite direction with respect to the direction of the longitudinal axis LA than the second long edge portion, that is towards the center part or the center line of the blade segment.

The third bend 44*a* is followed by a second substantially straight or slightly curved short edge portion 44*b*. The direction of the second short edge portion 44*b* is arranged to deviate from the direction of the longitudinal axis LA to a different direction than the second long edge portion 43, i.e., to an opposite direction with respect to the direction of the longitudinal axis LA than the second long edge portion, that is towards the center part or the center line of the blade segment.

The second short edge portion 44*b* is followed by a fourth bend 44*c* which is turned away from the direction of the second short edge portion 44*b*, i.e., to an opposite direction with respect to the direction of the longitudinal axis LA than the second short edge portion 44*b*, that is away from the center part or the center line of the blade segment. The fourth bend 44*c* is thus turned towards an opposite direction relative to the longitudinal axis LA than the third bend 44*a*.

The third bend 44*a*, the second short edge portion 44*b* and the fourth bend 44*c* provide a second elbow 44 in the second side edge 23 of the blade segment. In other words, the second elbow 44 in the second side edge 23 of the blade segment consists of the third bend 44*a*, the second short edge portion 44*b* following the third bend 44*a* and the fourth bend 44*c* following the second short edge portion 44*b*.

The fourth bend 44*c* or the second elbow 44 is, in turn, followed by a substantially straight third long edge portion 45 the direction of which is arranged to deviate from the direction of the longitudinal axis LA of the blade segment to the same direction as the first 41 and the second 43 long edge portions, i.e., away from the center part or the center line of the blade segment. In other words, the fourth bend 44*c* and, thus, the second elbow 44 is followed by a substantially straight third long edge portion 45 the direction of which is arranged to deviate from the direction of the longitudinal axis LA of the blade segment to the same direction as the first 41 and the second 43 long edge portions. The third long edge portion 45 is thus arranged to deviate with respect to the direction of the longitudinal axis LA to the same direction as the first 41 and the second 43 long edge portions.

The ratio of a length of the short edge portion 42*b*, 44*b* to a length of the long edge portion 41, 43, 45 is about 1:2-1:20.

In the embodiments of the blade segments of FIGS. 4*a*, 4*b* and 5, both side edges 22, 23 of the blade segment comprise at least two edge portions 31, 33, 35, 41, 43, 45 arranged to deviate from the direction of the longitudinal axis LA of the blade segment 4, 4*a*, 4*b*, 8, 8*a*, 8*b* and being connected by an elbow 32, 34, 42, 44 between each two edge portions 31, 33, 35, 41, 43, 45.

In the embodiments of the blade segments of FIGS. 4*a*, 4*b* and 5, the configurations of the side edges 22, 23 are also arranged to deviate from a mirror image with respect to the longitudinal axis LA of the blade segment. In other words, the side edges of the blade segments of FIGS. 4*a*, 4*b* and 5 are not mirror images of each other with respect to the longitudinal axis LA of the blade segment 4, 4*a*, 4*b*, 8, 8*a*, 8*b* at the center line of the blade segment 4, 4*a*, 4*b*, 8, 8*a*, 8*b*.

Generally, according to the disclosed solution, at least one side edge 22, 23 of the blade segment 4, 4*a*, 4*b*, 8, 8*a*, 8*b* comprises at least two edge portions 31, 33, 35, 41, 43, 45 the directions of which are arranged to deviate from the direction of the longitudinal axis LA of the blade segment 4, 4*a*, 4*b*, 8, 8*a*, 8*b*, and the at least two edge portions are connected by an elbow 32, 34, 42, 44 between each two edge portions 31, 33, 35, 41, 43, 45.

According to a further embodiment, the directions of the edge portions 31, 33, 35, 41, 43, 45 at the specific side edge 22, 23 are arranged to deviate to the same direction from the direction of the longitudinal axis LA and the elbow 32, 34, 42, 44 is turned away from the edge portions 31, 33, 35, 41, 43, 45 such that it deviates with respect to the direction of the longitudinal axis LA of the blade segment to the different direction than the edge portions 31, 33, 35, 41, 43, 45.

According to an embodiment of the blade segment, as schematically shown on the side of the first side edge 22 of the blade segment 4, 8 in FIG. 6, the reach of the elbows 32, 34, or more specifically the length of the short edge portion 32*b*, 34*b*, may be so arranged that it does not substantially exceed the edge axis LA', whereby a continuous slit-like opening 14, 15 between the neighboring segments 4, 8 may be provided. In other words, in this embodiment the elbows 32, 34 are arranged not to exceed the longitudinal axis LA' of the blade segment 4, 8 at the first side edge 22 of the blade segment 4, 8.

According to an embodiment of the blade segment, as schematically shown on the side of the second side edge 23 of the blade segment 4, 8 in FIG. 6, the reach of the elbows 42, 44 may be so arranged that the elbow extends up to the edge axis LA', like the elbow 44, or exceeds the edge axis LA', like the elbow 42. In other words, in this embodiment the elbows 42, 44 are arranged to extend up to the longitudinal axis LA' of the blade segment 4, 8 at the second side edge 22 of the blade segment 4, 8 or even exceed the longitudinal axis LA' of the blade segment 4, 8 at the second side edge 22 of the blade segment 4, 8. If the opposite side edges 22, 23 are not parallel the elbow may exceed the edge axis LA' even to such an extent that it enables contact with a neighboring segment, whereby a discontinuous slit-like opening 14, 15 between the neighboring segments 4, 8 may be provided.

The disclosed configuration of the side edge of the blade segment provides a shape of gentle zigzag that deviates from the direction of the longitudinal axis of the blade segment. When the configuration of the opposite side edge is selected in co-operation with the configuration of the first mentioned side edge, it provides longitudinal slit-like openings, i.e., flow paths, between the neighboring blade segments for supplying the fibrous material to be refined into the refining chamber between the stator and the rotor and for discharging the fibrous material already refined out of the refining chamber. This slit-like opening, having a stairs-like or step-shaped opening configuration, has therefore a center line the direction of which deviates from the direction of the axis of the blade segment at least at most part of the extension of the opening. This has the effect that an angle of incidence between the openings in the rotor and in the stator changes in the axial direction of the refiner, or the longitudinal axis and the edge axis of the blade segments, causing a point of incidence between the openings in the rotor and in the stator to move from the axial direction of the refiner or the longitudinal axis of the blade segments. This, in turn, has the effect that possible flow pulse variations and thus vibrations appearing during the operation of a refiner may be diminished.

According to an embodiment the slit-like opening has a width between 10 mm and 25 mm.

According to an embodiment, the edge portions at the same side edge 22, 23 of the blade segment and arranged to deviate to the same direction from the direction of the longitudinal axis LA of the blade segment are substantially parallel. The effect of this is that an opening of substantially constant width is easy to implement between neighboring blade segments.

According to an embodiment, each side edge of the blade segment comprises at least one elbow. The effect of this is that both side edges of the blade segment have a kind of shape of gentle zigzag, preventing thereby a significant portion of the side edge from following the longitudinal axis of the blade segment and thereby preventing a formation of opening portions possibly causing a tendency of vibration of the refiner during the operation thereof.

According to an embodiment, the elbows at the opposite side edges lie on the same normal level with respect to the longitudinal axis LA of the blade segment, the normal of the longitudinal axis LA of the blade segment being schematically shown in FIG. 5 with a broken line denoted with the reference sign N. This has the effect of providing an opening with a substantially constant width along the longitudinal extension of the opening.

According to an embodiment, a number of elbows at each side edge 22, 23 is from one to ten, preferably from two to six, or from two to seven, or from two to eight. When the number of elbows at the side edge is reasonable, the deviation of the direction of extension of the opening from the longitudinal axis of the blade segment may be ensured. Too dense zigzag shape of the side edge of the blade segment may result in a perpetual back-and-forth type flow path for the pulp which eventually does not differ so much from the vibrationally possibly undesired design.

According to an embodiment, an angle of the deviation of the elbow from the longitudinal axis LA of the blade segment is about 10-90 degrees, preferably from 10 to 60 degrees, and more preferably from 10 to 50 degrees.

According to an embodiment, a direction of an extension of the elbow is substantially parallel to a direction of an extension of a blade bar. In other words, the elbow is arranged to form an angle which is substantially parallel to the blade bar angle applied in the blade segment.

According to an embodiment, configurations of the side edges 22, 23 are arranged to deviate from a mirror image with respect to a longitudinal axis of the blade segment, or in other words, the side edges of the blade segment are not mirror images of each other with respect to the longitudinal axis LA of the blade segment.

It will be obvious to a person skilled in the art that, as the technology advances, the inventive concept can be implemented in various ways. The invention and its embodiments are not limited to the examples described above but may vary within the scope of the claims.

The invention claimed is:

1. A blade segment for a refiner for refining fibrous material, the blade segment comprising:

a first end edge and a second end edge opposite to the first end edge in a direction of a longitudinal axis of the blade segment;

a first side edge and a second side edge opposite to the first side edge, the first side edge and the second side edge extending between the first end edge and the second end edge;

a refining surface comprising blade bars and blade grooves therebetween on a front surface of the blade segment; and wherein the first side edge and the second side edge each comprise at least two long edge portions which are inclined from the direction of the longitudinal axis of the blade segment and being connected by an elbow between each of said at least two long edge portions, the elbow having a first bend, a short edge portion which is shorter than the long edge portions, the short edge portion following the first bend and a second bend following the short edge portion;

wherein an edge axis extends in the longitudinal direction from a first shoulder at the first end edge at the first side edge to a second shoulder at the second end edge at the first side edge, and at least one of the elbows of the first side edge has portions which protrude beyond the edge axis.

2. The blade segment of claim 1 wherein the long edge portions of the first side edge are inclined in the same direction with respect to the direction of the longitudinal axis and each elbow of the first side edge is turned away from the long edge portions of the first side edge to be inclined in a different direction than the long edge portions of the first side edge.

3. The blade segment of claim 1 wherein the long edge portions of the first side edge are parallel to one another.

4. The blade segment of claim 1, wherein the first side edge comprises, in a direction from the first end edge towards the second end edge, at least the straight first long edge portion of said at least two long edge portions inclined from the direction of the longitudinal axis of the blade segment, the first bend following the first long edge portion and turned away from the direction of the first long edge portion, the straight short edge portion following the first bend and inclined from the direction of the longitudinal axis of the blade segment to a different direction than the first long edge portion, the second bend following the first short edge portion and turned away from the direction of the first short edge portion and the straight second long edge portion of said at least two long edge portions following the second bend and inclined from the direction of the longitudinal axis of the blade segment to the same direction as the first long edge portion, wherein the first bend, the short edge portion and the second bend provide the elbow in the first side edge of the blade segment.

5. The blade segment of claim 1, wherein the elbows at the opposite first side edge and second side edge lie on a same normal level with respect to the longitudinal axis.

6. The blade segment of claim 1, wherein a number of elbows at each side edge is from two to seven.

7. The blade segment of claim 1 wherein of the short edge portion of each elbow is inclined with respect to the longitudinal axis by 10-90 degrees.

8. The blade segment of claim 1 wherein the blade bars and grooves extend in a first direction, and wherein the short edge portion of the elbow on each of the first side edge and the second side edge extends in a direction which is parallel to the first direction.

9. The blade segment of claim 1 wherein the first side edge and the second side edge are not mirror images of each other with respect to the longitudinal axis of the blade segment.

10. The blade segment of claim 1, further comprising the first shoulder positioned radially outwardly from the second shoulder, said first shoulder and said second shoulder configured for contacting a neighboring blade segment when assembled to provide a part of a refining surface of a refining element of a refiner.

11. The blade segment of claim 1 wherein a ratio of a length of the short edge portions to a length of the long edge portions of the first side edge is 1:2-1:20.

12. The blade segment of claim 1, wherein said blade segment is configured to be positioned on an apparatus defining with the blade segment a refiner for refining fibrous material.

13. The blade segment and refiner of claim 12, wherein said blade segment is configured to be positioned alongside a second blade segment such that there is a continuous opening between the blade segment and the second blade segment.

14. The blade segment and refiner of claim 12, wherein said blade segment is configured to be positioned alongside a second blade segment such that there is a discontinuous opening between the blade segment and the second blade segment.

* * * * *